United States Patent [19]

Nishigaki et al.

[11] Patent Number: 4,466,829

[45] Date of Patent: Aug. 21, 1984

[54] TUNGSTEN CARBIDE-BASE HARD ALLOY FOR HOT-WORKING APPARATUS MEMBERS

[75] Inventors: Kenichi Nishigaki; Magoichi Takahashi, both of Omiya; Keiichi Wakashima, Tokyo, all of Japan

[73] Assignee: Mitsubishi Kinzoku Kabushiki Kaisha, Tokyo, Japan

[21] Appl. No.: 364,644

[22] Filed: Apr. 2, 1982

[30] Foreign Application Priority Data

| | | | |
|---|---|---|---|
| Apr. 6, 1981 | [JP] | Japan | 56-50528 |
| May 15, 1981 | [JP] | Japan | 56-73030 |
| Aug. 17, 1981 | [JP] | Japan | 56-128484 |
| Aug. 17, 1981 | [JP] | Japan | 56-128485 |

[51] Int. Cl.[3] ..... B22F 3/14; C22C 29/00

[52] U.S. Cl. ..... 75/240; 75/241; 75/252; 75/255

[58] Field of Search ..... 75/251, 252, 254, 255, 75/236, 238, 240, 241; 420/431

[56] References Cited

U.S. PATENT DOCUMENTS

| | | | |
|---|---|---|---|
| 3,771,975 | 11/1973 | Frehn | 75/236 |
| 3,916,497 | 11/1975 | Doi et al. | 75/236 |
| 3,917,463 | 11/1975 | Doi et al. | 75/236 |
| 3,993,446 | 11/1976 | Okawa | 75/241 |

FOREIGN PATENT DOCUMENTS

| | | | |
|---|---|---|---|
| 2066359 | 8/1971 | France | 75/236 |
| WO80/02569 | 11/1980 | PCT Int'l App. | 75/240 |
| 2000810 | 1/1979 | United Kingdom | 75/236 |

*Primary Examiner*—L. Dewayne Rutledge
*Assistant Examiner*—John J. Zimmerman
*Attorney, Agent, or Firm*—Wenderoth, Lind & Ponack

[57] ABSTRACT

A WC-Ni-Co-Al-Cr system hard alloy suitable as a material for hot working apparatus members has a lower Co content than conventionally used WC-Co system alloys and contains in place thereof greater quantities of Ni and Al, whereby, and also because the oxygen content is suppressed at a low level, fine particles of $\gamma'$ phase ($Ni_3Al$) are precipitated in a binder phase which binds the disperse phase of WC to impart characteristics such as excellent toughness, abrasion resistance, high-temperature strength, and oxidation resistance.

7 Claims, No Drawings

TUNGSTEN CARBIDE-BASE HARD ALLOY FOR HOT-WORKING APPARATUS MEMBERS

BACKGROUND OF THE INVENTION

This invention relates to a tungsten carbide (hereinafter indicated by WC)-base hard alloy having toughness and abrasion resistance possessed by WC-base hard alloys as well as excellent high-temperature strength, hot-impact resistance and hot-fatigue resistance, which is particularly suitable for use as a material for hot working apparatus members for which these characteristics are required, such as hot-rolling rolls, hot-rolling guide rollers and hot-forging dies, etc.

As materials for hot working apparatus members as mentioned above, tool steels or cast steels conventionally used are frequently replaced in recent years by WC-base hard alloy, comprising WC having a high value of high-temperature hardness as disperse phase bound with binding metals composed principally of Co. As such WC-base hard alloys, there have been known those of the WC-Co system, the WC-Co-Ni system, and the WC-Co-Ni-Cr system. However, while a WC-base hard alloy has excellent toughness and abrasion resistance on the one hand, it does not have sufficient high-temperature strength. Therefore, as in the case of hot-rolling rolls for steel-wire rods, when the roll surfaces are subjected to heating at a high temperature under application of pressure by running steel wire rods at 1,000° to 1,100° C., and the roll surfaces are also chilled with water, the roll surfaces will suffer from thermal cracks or coarsening under such conditions of repeated cycles of heating and cooling. WC-Co-Ni system and WC-Co-Ni-Cr-system hard alloys, while having better characteristics than a WC-Co system hard alloy, have a drawback in that they are readily chipped, which is believed to be due particularly to thermal cracks under severe conditions of low speed and high load, thus failing to exhibit satisfactory performance.

Meanwhile, there has also been proposed a WC-Co-Ni-Al system hard alloy, comprising a disperse phase of WC, and 20 to 70% (by weight, hereinafter the same unless otherwise noted) of Co, 0.1 to 10% Ni, and 0.05 to 5% of Al as binder metals, and further containing, if desired, $Cr_3C_2$, TaC and TiC (Japanese Laid-open Patent Application No. 90511/75). This hard alloy is also still not satisfactory in mechanical characteristics such as transverse rupture strength, tensile strength, hardness, etc., especially at high temperatures. Further, because of its high content of Co, the alloy has poor oxidation resistance and corrosion resistance. Thus, this alloy is also not satisfactory as a hard alloy for hot-working apparatus members.

SUMMARY OF THE INVENTION

A principal object of the present invention is to provide a WC-base hard alloy which has excellent high temperature strength while retaining the excellent toughness and abrasion resistance of conventional WC-base hard alloys, and further has excellent hot-impact resistance, hot-fatigue resistance, oxidation resistance, and corrosion resistance, thus being endowed with characteristics required for hot-working apparatus members.

The idea occurred to us that precipitation of the $\gamma'$ ($Ni_3$, Al) phase having excellent high-temperature characteristics might be promoted effectively for achievement of the above object by lowering the Co content as a binder metal. However, if the contents of Ni and Al are simply increased, the resulting alloy becomes brittle as described in the above Japanese Laid-open Patent Application No. 90511/75. This is because the grains of the $\gamma'$ phase become coarse. However, according to our further study, it has been found that by controlling the content of oxygen introduced as an inevitable impurity into the alloy, so as to be decreased below a certain level, a large amount of fine $\gamma'$ phase can be precipitated, thereby providing a WC-base hard alloy further improved in mechanical characteristics, especially those at high temperatures. The WC-base hard alloy for hot working apparatus members according to the present invention is based on the above finding. More specifically, it comprises a disperse phase and a binder phase and contains Cr: 0.1–2%,
Al: 0.1–3%,
Ni: 5–30%,
Co: 2.5–15%, and
a remainder of tungsten carbide as the principal ingredient and inevitable impurities, wherein: the content of oxygen as an inevitable impurity is not more than 0.05%; the tungsten carbide forms the disperse phase having an average particle size of 2–8 μm; and the binder phase contains fine particles of precipitated $\gamma'$ phase of $Ni_3Al$ structure, all percentages being by weight.

DETAILED DESCRIPTION OF THE INVENTION

The alloy according to the present invention can be prepared according to conventional powder metallurgy but, as far as starting powders are concerned, it is preferable to use chromium nitride (hereinafter indicated by $Cr_2N$) powder as Cr source, and aluminum nitride (hereinafter indicated by AlN) powder as Al source. These nitride powders are denitrified at the time of sintering in vacuo, whereby only Cr and Al are very easily diffused throughout the Ni-Co alloy binder phase to avoid substantial incorporation of nitrogen in the resulting sintered product. Moreover, the oxygen content in the sintered product can be controlled to 0.05% or less. In contrast thereto, when Al powders or Ni-Al alloy powders are employed as starting powders as in the conventional processes, fine $Al_2O_3$ particles are inevitably formed and dispersed in the binder phase of the sintered product.

Furthermore, with the increase of Al or Ni-Al alloy powders, the quantity of $Al_2O_3$ is increased, resulting in increased pores in the sintered product and coarsening of the $\gamma'$ phase precipitated in the binder phase, whereby the toughness and strength of the sintered product are lowered. In this case, the oxygen content generally amounts to 0.08 to 0.15%. In contrast, when AlN powders are employed, there is no increase in the oxygen content in the sintered product, which is maintained constantly at a level of 0.05% or lower. Consequently, there occurs no generation of pores nor coarsening phenomenon of the $\gamma'$ phase, whereby no deterioration whatsoever of strength and toughness occur. Further, AlN powders can be made fine more easily than Al or Ni-Al alloy powders, being more advantageous also in this respect for prevention of pore generation and formation of fine $\gamma'$ phase.

The reasons for numerical limitations for the components in the composition and WC particles in the WC-base hard alloy of the present invention are as follows.

(a) Cr

The Cr component acts to improve corrosion resistance and oxidation resistance of the alloy. With a Cr content of less than 0.1%, no such desired effect can be obtained, while the toughness tends to be lowered with a content in excess of 2%. Thus, the Cr content was determined as 0.1 to 2%.

(b) Al

The Al component forms a solid solution in the binder phase and also acts to improve heat resistance of the binder phase by precipitation as $\gamma'$ phase. With an Al content less than 0.1%, no desired heat resistance can be obtained, while embrittlement may be caused by precipitation of NiAl intermetallic compound when Al is contained in excess of 3%. Thus, the Al content was determined as 0.1 to 3%.

(c) Ni

The Ni acts to improve the strength of the alloy. With a Ni content of less than 5%, no desirable high strength can be ensured. On the other hand, an excessive content over 30% tends to lower the hardness. Thus, the Ni content was determined as 5 to 30%.

(d) Co

The Co component forms a solid solution in the binder phase and also acts to improve heat resistance of the binder phase by precipitation as $\gamma'$ phase. With a Co content less than 2.5%, no desired heat resistance can be obtained. On the other hand, an excessive content over 15% tends to lower the hardness similarly as in the case of Ni, simultaneously with lowering of oxidation resistance and corrosion resistance. Thus, the Co content was determined as 2.5% to 15%.

(e) Oxygen

As described above, the alloy according to the present invention is markedly improved in alloy strength by dispersing the precipitated fine $\gamma'$ phase in the binder phase. When the oxygen content exceeds 0.05%, oxygen will be bonded preferentially with Al to form $Al_2O_3$, with the result that not only formation of the $\gamma'$ phase is inhibited but also coarsening of the $\gamma'$ phase particles is brought about with concomitant generation of pores, whereby strength and toughness of the alloy will be markedly lowered. For this reason, the upper limit of oxygen content was determined as 0.05%. Thus, according to the present invention, the precipitated $\gamma'$ phase will have an average particle diameter of 0.3 $\mu$m or less, especially 0.02 to 0.1 $\mu$m. In this connection, in the conventional alloys with an oxygen content exceeding 0.05% prepared with the use of Al powders or Ni-Al powders as Al source, the average particle diameter of the $\gamma'$ phase is 0.5 $\mu$m or more, even as large as 2 to 3 $\mu$m.

(f) Average particle diameter of WC particles

With an average particle diameter of less than 2 $\mu$m, desirable high temperature strength cannot be ensured. On the other hand, an average particle diameter in excess of 8 $\mu$m will lower the alloy hardness. Hence, the average particle diameter was determined as 2 to 8 $\mu$m.

The above description has been made in terms of the basic embodiment of the WC-base hard alloy of the present invention. However, the alloy of the present invention can further be improved in its characteristics by incorporating the following components, if desired.

(g) Mo

The Mo component forms a solid solution in the binder phase and acts to improve the high temperature hardness thereof. However, at a Mo content level less than 0.1%, desirable high temperature hardness cannot be ensured. On the other hand, a content exceeding 1% will result in lowering the strength of the alloy. Thus, the content is preferably 0.1 to 1%.

(h) B and Zr

These components form a solid solution in the binder phase and act to markedly improve oxidation resistance, and also to improve toughness through improvement of the interface strength between WC and the binder phase. At levels of less than 0.01%, desirable oxidation resistance and improvement of toughness cannot be obtained, while a content in excess of 0.2% will, on the contrary, result in a brittle alloy. Thus, when these components are to be added, the total quantity of one or two of these components is preferably 0.01 to 0.2%.

(i) VC, TaC and NbC

These components act to inhibit growth of grains of WC during sintering and also to improve to a great extent the high-temperature strength and oxidation resistance of the alloy by homogeneous dispersion together with WC throughout the binder phase. But when their content is less than 0.1%, the desired effect of the aforesaid actions cannot be obtained. On the other hand, when they are contained in a quantity of over 2%, the toughness of the alloy tends to be lowered. Thus, it is preferred to control the total content of these components to 0.1 to 2%.

The hard alloy of the present invention is composed of WC as the principal ingredient, corresponding substantially to the remainder of the alloy other than the above components, which preferably occupies 50% or more, especially 60% or more, of the alloy.

The alloy of the present invention can be prepared according to conventional powder metallurgy, that is, by mixing powdery starting materials of respective components as described above, compression molding the powder mixture, and sintering the resulting molded product by holding it in vacuo or in an inert atmosphere at a temperature of 1,300° to 1,450° C. for 0.5 to 2 hours. Suitable particle sizes of the starting powders are of the order of 3 to 6 $\mu$m for WC and 0.5 to 2.0 $\mu$m for the other components.

The alloy of the invention is obtained by cooling the sintered product. The excellent characteristics of the alloy can be obtained substantially regardless of whether the sintered product is cooled gradually or relatively rapidly. Rapid cooling is effected, for example, by transferring the sintered product from a hot sintering zone to a cooling zone where separate zones are used. It is preferred, however, to hold the sintered product at a temperature of 600° to 900° C. for 1 to 4 hours in order to promote the precipitation of the $\gamma'$ phase. This holding of the sintered product at the above temperature may be carried out either during the course of cooling or by reheating the sintered product which has been once cooled to room temperature. Essentially the same performance can be obtained.

The nature and utility of the alloy of present invention are further illustrated by referring to the following Examples in comparison with Comparative Examples.

EXAMPLE 1

As starting powders use was made of WC powders respectively having average particle sizes of 1 μm, 5 μm and 10 μm; Ni powders having an average particle size of 1.5 μm; Co powders having an average particle size of 1.2 μm; $Cr_2N$ powders having an average particle size of 2 μm; and AlN powders having an average particle size of 1.5 μm, all of which were commercially available. These powders were formulated into the compositions indicated in Table 1 (only Cr and Al contents are indicated for $Cr_2N$ and AlN, because of elimination of N during sintering), by mixing under conventional conditions. These compositions were respectively subjected to compression molding under a pressure of 1,000 Kg/cm$^2$ into compressed powdery products, followed by sintering in vacuo by holding the compressed products at the temperatures indicated in Table 1 for one hour to prepare the hard alloys 1–9 of the present invention and Comparative hard alloys 1–11 having final compositions substantially the same as those formulated. In each of the Comparative hard alloys, the content of either one component or the average particle size of WC particles (indicated by the mark * in Table 1, similarly in other Tables) is outside the scope of the present invention. The results of measurements of tensile strength, hardness (Rockwell A scale), transverse rupture strength and average particle diameters of the WC particles are also shown in Table 1.

Next, from the above hard alloys 2, 6 and 8, and further from a spherulitic graphite cast steel (FCD 55) and WC-base hard alloy (WC-15%Co) of the prior art, guide rollers for hot-rolling rolls for ordinary steel wires were prepared and assembled in an actual operating machine, for testing. Such guide rollers are provided for guiding wires to be rolled, and suppressing vibrations thereof, and are used under severe conditions of repeated heating and cooling, that is, under heating on one side with the hot wires while under water cooling on the other side. The guide rollers were used under the conditions of a wire temperature of 1,050° C. and a wire passing speed of 30 m/sec, and the quantity of the wire passed during of the serviceable life of each guide roller was measured.

As a result, the guide roller made of the spherulitic graphite cast steel reached the end of its serviceable life at 120 tons of wire passed with great abrasion at the caliber portion, and the guide roller made of the hard alloy of the prior art reached its life at 800 tons of wire passed with generation of thermal cracks and peel-off phenomena at the caliber portion. In contrast, the guide roller made of each of the hard alloys of the present invention incurred only slight thermal cracks recognizable at the caliber portion even after the passing 2,100 tons or more of wire and was judged to be serviceable for further use.

EXAMPLE 2

According to substantially the same method as described in Example 1 except for addition of Mo powders of an average particle diameter of 0.7 μm, the hard alloys 21–36 of the present invention and Comparative hard alloys 21–33 were prepared. These alloys were tested for tensile strength, normal temperature hardness (Rockwell hardness, A scale), high temperature hardness at 800° C. (Vickers hardness) and transverse rupture strength. The results are shown in Tables 2 and 3 together with average particle diameters and oxygen contents of the WC particles of the above alloys.

TABLE 1

| Kind of alloy | | Composition (wt. %) WC | Cr | Al | Ni | Co | $O_2$ | Sintering temperature (°C.) | Average particle size of WC particles (μm) | Tensile strength (Kg/mm$^2$) | Hardness (HRA) | Transverse rupture strength (Kg/mm$^2$) |
|---|---|---|---|---|---|---|---|---|---|---|---|---|
| Hard alloys of the invention | 1 | Remainder | 0.1 | 2 | 15 | 10 | 0.04 | 1375 | 4.0 | 195 | 80.5 | 320 |
| | 2 | " | 1 | 2 | 15 | 10 | 0.03 | 1375 | 3.5 | 185 | 81.0 | 320 |
| | 3 | " | 2 | 2 | 15 | 10 | 0.04 | 1400 | 4.5 | 200 | 81.5 | 275 |
| | 4 | " | 1 | 0.1 | 15 | 10 | 0.02 | 1375 | 6.0 | 180 | 81.3 | 285 |
| | 5 | " | 1 | 3 | 15 | 10 | 0.05 | 1350 | 3.5 | 178 | 80.2 | 300 |
| | 6 | " | 1 | 0.5 | 5 | 10 | 0.03 | 1400 | 4.5 | 190 | 88.0 | 300 |
| | 7 | " | 1 | 2 | 30 | 5 | 0.04 | 1330 | 2.5 | 170 | 77.2 | 285 |
| | 8 | " | 1 | 2 | 15 | 2.5 | 0.05 | 1425 | 6.5 | 165 | 85.5 | 315 |
| | 9 | " | 1 | 2 | 15 | 15 | 0.02 | 1350 | 3.5 | 170 | 79.8 | 320 |
| Comparative hard alloys | 1 | " | —* | 2 | 15 | 10 | 0.05 | 1375 | 4.0 | 185 | 80.1 | 250 |
| | 2 | " | 2.5* | 2 | 15 | 10 | 0.05 | 1400 | 4.5 | 175 | 82.0 | 175 |
| | 3 | " | 1 | —* | 15 | 10 | 0.04 | 1375 | 6.0 | 145 | 81.0 | 240 |
| | 4 | " | 1 | 3.5* | 15 | 10 | 0.04 | 1375 | 3.5 | 155 | 81.0 | 215 |
| | 5 | " | 1 | 2 | 4* | 10 | 0.04 | 1450 | 5.5 | 155 | 87.6 | 250 |
| | 6 | " | 1 | 2 | 32* | 5 | 0.05 | 1330 | 2.5 | 150 | 76.5 | 260 |
| | 7 | " | 1 | 2 | 15 | 2* | 0.05 | 1425 | 6.5 | 160 | 85.0 | 266 |
| | 8 | " | 1 | 2 | 15 | 18* | 0.03 | 1330 | 2.2 | 170 | 76.5 | 280 |
| | 9 | " | 1 | 2 | 15 | 10 | 0.05 | 1375 | 1.5* | 142 | 83.0 | 175 |
| | 10 | " | 1 | 2 | 15 | 10 | 0.05 | 1375 | 8.0* | 160 | 78.2 | 260 |
| | 11 | " | 1 | 2 | 15 | 10 | 0.09* | 1375 | 5.0 | 155 | 81.0 | 215 |

As is apparent from the results shown in Table 1, each of the hard alloys 1 to 9 of the present invention has high strength, hardness and toughness, while Comparative hard alloys 1 to 11 are, as a whole, inferior in these characteristics.

TABLE 2

| Kind of alloy | | Composition (wt. %) Mo | Cr | Al | Ni | Co | WC | Sintering temperature (°C.) | Oxygen content in alloy (%) | Average particle size of WC particles in alloy (μm) | Tensile strength (Kg/mm²) | Transverse rupture strength (Kg/mm²) | Hardness Room temperature (HRA) | 800° C. (Hv) |
|---|---|---|---|---|---|---|---|---|---|---|---|---|---|---|
| Hard alloys of the invention | 21 | 0.1 | 1 | 1 | 10 | 5 | Remainder | 1400 | 0.04 | 4.5 | 175 | 330 | 85.5 | 340 |
| | 22 | 0.5 | 1 | 1 | 10 | 5 | " | | 0.05 | 4.8 | 180 | 315 | 85.8 | 357 |
| | 23 | 1 | 1 | 1 | 10 | 5 | " | | 0.04 | 4.4 | 185 | 310 | 86.1 | 384 |
| | 24 | 0.5 | 0.1 | 1 | 10 | 5 | " | | 0.03 | 5.2 | 180 | 320 | 85.3 | 333 |
| | 25 | 0.5 | 2 | 1 | 10 | 5 | " | | 0.04 | 4.9 | 170 | 300 | 86.3 | 370 |
| | 26 | 0.5 | 1 | 0.1 | 10 | 5 | " | | 0.02 | 5.5 | 175 | 305 | 85.3 | 344 |
| | 27 | 0.5 | 1 | 2 | 10 | 5 | " | | 0.05 | 4.3 | 183 | 310 | 86.4 | 355 |
| | 28 | 0.5 | 1 | 3 | 10 | 5 | " | | 0.05 | 3.2 | 171 | 304 | 86.2 | 361 |
| | 29 | 0.5 | 1 | 1 | 5 | 5 | " | 1450 | 0.04 | 2.9 | 161 | 288 | 87.5 | 368 |
| | 30 | 0.5 | 1 | 1 | 20 | 5 | " | 1370 | 0.03 | 6.2 | 188 | 329 | 82.3 | 311 |
| | 31 | 0.5 | 1 | 1 | 30 | 5 | " | 1350 | 0.03 | 7.5 | 191 | 344 | 80.1 | 305 |
| | 32 | 0.5 | 1 | 1 | 10 | 2.5 | " | 1400 | 0.04 | 4.0 | 177 | 308 | 86.2 | 359 |
| | 33 | 0.5 | 1 | 1 | 10 | 10 | " | | 0.02 | 3.1 | 184 | 318 | 83.6 | 322 |
| | 34 | 0.5 | 1 | 1 | 10 | 15 | " | 1370 | 0.04 | 7.0 | 186 | 320 | 82.9 | 313 |
| | 35 | 0.5 | 1 | 1 | 5 | 10 | " | 1400 | 0.04 | 2.1 | 174 | 314 | 86.1 | 369 |
| | 36 | 0.5 | 1 | 1 | 10 | 15 | " | | 0.04 | 7.9 | 191 | 298 | 83.5 | 322 |

TABLE 3

| Kind of alloy | | Composition (wt. %) Mo | Cr | Al | Ni | Co | WC | Sintering temperature (°C.) | Oxygen content in alloy (%) | Average particle size of WC particles in alloy (μm) | Tensile strength (Kg/mm²) | Transverse rupture strength (Kg/mm²) | Hardness Room temperature (HRA) | 800° C. (Hv) |
|---|---|---|---|---|---|---|---|---|---|---|---|---|---|---|
| Comparative Hard alloys | 21 | 0.05* | 1 | 1 | 10 | 5 | Remainder | 1400 | 0.04 | 4.4 | 143 | 283 | 84.5 | 320 |
| | 22 | 1.2* | 1 | 1 | 10 | 5 | Remainder | | 0.05 | 4.1 | 140 | 254 | 84.9 | 355 |
| | 23 | 0.5 | 0.05* | 1 | 10 | 5 | Remainder | | 0.05 | 5.3 | 145 | 261 | 84.5 | 338 |
| | 24 | 0.5 | 2.5* | 1 | 10 | 5 | Remainder | | 0.03 | 3.8 | 133 | 188 | 85.1 | 363 |
| | 25 | 0.5 | 1 | 0.05* | 10 | 5 | Remainder | | 0.03 | 5.0 | 137 | 225 | 84.5 | 315 |
| | 26 | 0.5 | 1 | 3.3* | 10 | 5 | Remainder | | 0.05 | 3.5 | 129 | 210 | 84.9 | 345 |
| | 27 | 0.5 | 1 | 1 | 4.5* | 5 | Remainder | 1450 | 0.04 | 6.0 | 115 | 145 | 87.0 | 388 |
| | 28 | 0.5 | 1 | 1 | 31.5* | 5 | Remainder | 1340 | 0.04 | 7.7 | 160 | 266 | 77.4 | 288 |
| | 29 | 0.5 | 1 | 1.5 | 10 | 2.3* | Remainder | 1430 | 0.05 | 6.1 | 140 | 190 | 85.5 | 356 |
| | 30 | 0.5 | 1 | 1.5 | 10 | 16.8* | Remainder | 1370 | 0.05 | 7.3 | 158 | 200 | 80.9 | 312 |
| | 31 | 0.5 | 1 | 1.5 | 10 | 5 | Remainder | 1400 | 0.06* | 5.5 | 153 | 257 | 80.5 | 315 |
| | 32 | 0.5 | 1 | 1.5 | 10 | 5 | Re- | | 0.04 | 1.5* | 149 | 243 | 85.9 | 310 |
| | 33 | 0.5 | 1 | 1.5 | 10 | 5 | Remainder | | 0.04 | 9.0* | 139 | 210 | 83.2 | 315 |

By comparison of Table 2 and Table 3, it can be seen that each of the hard alloys of the present invention further containing Mo has excellent strength, toughness, room-temperature and high-temperature hardnesses, being substantially superior to the Comparative hard alloys in at least one of these properties.

When guide rollers for hot-rolling rolls were prepared from the above super-hard alloys 21, 23 and 25 and tested by assembling in an actual operating machine, each guide roller incurred only slight thermal cracks recognizable at the caliber portion even after the passing of 2,100 tons or more of wire, and was judged to be serviceable for further use.

EXAMPLE 3

The above Example was repeated except for further addition of powders of B or Zr with average particle diameters of 2 μm to obtain hard alloys 41 to 60 of the present invention and Comparative hard alloys 41 to 49 as shown in Table 4 and Table 5.

These alloys were tested similarly as in the above Examples and also with respect to weight increase by oxidation at 800° C. for one hour. The results are also shown in Tables 4 and 5.

By comparison of Table 4 and Table 5, it can be seen that each of the hard alloys of the present invention containing B or Zr is excellent in strength, toughness, room-temperature and high-temperature hardnesses and is also excellent in oxidation resistance.

TABLE 4

| Kind of alloy | | Composition (wt. %) Cr | Al | Ni | Co | B | Zr | Mo | WC | Oxygen content in alloy (%) | Average particle size of WC particles in alloy (μm) | Tensile strength (Kg/mm²) | Transverse rupture strength (Kg/mm²) | Hardness Room temperature (HRA) | Hardness 800° C. (Hv) | Increased weight by oxidation (mg/cm²) |
|---|---|---|---|---|---|---|---|---|---|---|---|---|---|---|---|---|
| Hard alloys of the invention | 41 | 0.1 | 1.5 | 12 | 9 | 0.1 | — | — | Remainder | 0.03 | 4.5 | 162 | 308 | 83.7 | 425 | 7.0 |
| | 42 | 1 | 1.5 | 12 | 9 | 0.1 | — | — | Remainder | 0.03 | 4.5 | 154 | 305 | 84.0 | 455 | 5.1 |
| | 43 | 2 | 1.5 | 12 | 9 | 0.1 | — | — | Remainder | 0.03 | 4.5 | 150 | 300 | 84.2 | 467 | 4.0 |
| | 44 | 1 | 0.1 | 12 | 9 | 0.1 | — | — | Remainder | 0.02 | 4.5 | 147 | 305 | 83.0 | 415 | 6.1 |
| | 45 | 1 | 3 | 12 | 9 | 0.1 | — | — | Remainder | 0.04 | 4.5 | 151 | 295 | 84.5 | 464 | 4.0 |
| | 46 | 1 | 1.5 | 5 | 9 | 0.1 | — | — | Remainder | 0.03 | 5.6 | 143 | 290 | 87.2 | 492 | 3.7 |
| | 47 | 1 | 1.5 | 30 | 9 | 0.1 | — | — | Remainder | 0.02 | 2.5 | 147 | 295 | 77.2 | 388 | 2.2 |
| | 48 | 1 | 1.5 | 12 | 2.5 | 0.1 | — | — | Remainder | 0.03 | 4.5 | 149 | 303 | 86.9 | 503 | 2.9 |
| | 49 | 1 | 1.5 | 12 | 15 | 0.1 | — | — | Remainder | 0.04 | 2.8 | 158 | 325 | 80.3 | 405 | 3.8 |
| | 50 | 1 | 1.5 | 12 | 9 | 0.01 | — | — | Remainder | 0.03 | 4.5 | 144 | 318 | 83.5 | 422 | 5.9 |
| | 51 | 1 | 1.5 | 12 | 9 | 0.2 | — | — | Remainder | 0.02 | 4.5 | 146 | 305 | 84.6 | 466 | 2.6 |
| | 52 | 1 | 1.5 | 12 | 9 | — | 0.01 | — | Remainder | 0.03 | 4.5 | 145 | 320 | 83.5 | 420 | 6.0 |
| | 53 | 1 | 1.5 | 12 | 9 | — | 0.1 | — | Remainder | 0.03 | 4.5 | 155 | 308 | 83.9 | 451 | 5.0 |
| | 54 | 1 | 1.5 | 12 | 9 | — | 0.2 | — | Remainder | 0.02 | 4.5 | 145 | 319 | 84.7 | 469 | 2.4 |
| | 55 | 1 | 1.5 | 12 | 9 | 0.05 | 0.05 | — | Remainder | 0.04 | 4.5 | 143 | 302 | 83.4 | 441 | 5.0 |
| | 56 | 1 | 1.5 | 12 | 9 | 0.1 | — | 0.1 | Remainder | 0.04 | 4.5 | 146 | 306 | 84.7 | 468 | 3.0 |
| | 57 | 1 | 1.5 | 12 | 9 | — | 0.1 | 0.5 | Remainder | 0.05 | 4.5 | 148 | 310 | 84.9 | 477 | 4.1 |
| | 58 | 1 | 1.5 | 12 | 9 | 0.1 | — | 0.5 | Remainder | 0.05 | 4.5 | 140 | 308 | 84.8 | 473 | 4.2 |
| | 59 | 1 | 1.5 | 12 | 9 | — | 0.1 | 1 | Remainder | 0.04 | 4.5 | 140 | 285 | 85.3 | 479 | 5.6 |
| | 60 | 1 | 1.5 | 12 | 9 | 0.05 | 0.05 | 0.5 | Remainder | 0.05 | 4.5 | 140 | 305 | 84.7 | 466 | 4.0 |

TABLE 5

| Kind of alloy | | Composition (wt. %) Cr | Al | Ni | Co | B | Zr | Mo | WC | Oxygen content in alloy (%) | Average particle size of WC particles in alloy (μm) | Tensile strength (Kg/mm²) | Transverse rupture strength (Kg/mm²) | Hardness Room temperature (HRA) | 800° C. (Hv) | Increased weight by oxidation (mg/cm²) |
|---|---|---|---|---|---|---|---|---|---|---|---|---|---|---|---|---|
| Comparative hard alloys | 41 | —* | 1.5 | 12 | 9 | 0.1 | — | — | Remainder | 0.03 | 4.5 | 133 | 285 | 83.2 | 400 | 8.8 |
| | 42 | 1 | —* | 12 | 9 | — | 0.1 | — | Remainder | 0.05 | 4.5 | 130 | 280 | 82.2 | 365 | 8.2 |
| | 43 | 1 | 1.5 | 4* | 9 | 0.1 | — | — | Remainder | 0.05 | 5.6 | 130 | 264 | 86.5 | 474 | 5.1 |
| | 44 | 1 | 1.5 | 32* | 9 | 0.05 | 0.05 | — | Remainder | 0.02 | 2.5 | 128 | 318 | 76.1 | 360 | 2.8 |
| | 45 | 1 | 1.5 | 12 | 2* | 0.05 | 0.05 | — | Remainder | 0.04 | 5.6 | 122 | 258 | 86.0 | 468 | 4.7 |
| | 46 | 1 | 1.5 | 12 | 16* | — | 0.1 | — | Remainder | 0.04 | 2.8 | 132 | 305 | 79.2 | 380 | 3.2 |
| | 47 | 1 | 1.5 | 12 | 9 | —* | —* | — | Remainder | 0.03 | 4.5 | 135 | 258 | 83.6 | 448 | 5.6 |
| | 48 | 1 | 1.5 | 12 | 9 | 0.1 | — | — | Remainder | 0.05 | 1.5* | 133 | 255 | 84.7 | 450 | 6.9 |
| | 49 | 1 | 1.5 | 12 | 9 | — | 0.1 | — | Remainder | 0.02 | 9* | 122 | 229 | 81.1 | 345 | 5.5 |

When guide rollers for hot-rolling rolls were prepared from the above hard alloys 43, 54 and 57 and tested by assembling in an actual operating machine, each guide roller incurred only slight thermal cracks recognizable at the caliber portion even after the passing of 2,500 tons or more of wires and was judged to be serviceable for further use.

EXAMPLE 4

The procedure of the above Examples was repeated except for further addition of powders of VC, TaC or NbC with average particle diameters of 1.5 μm to obtain hard alloys 61 to 86 of the present invention and Comparative hard alloys 61 to 69 as shown in Table 6 and Table 7.

Measurements of the characteristics of these alloys were carried out, whereupon the results shown in Table 6 and Table 7 were obtained.

It can be seen from Table 6 and Table 7 that each of the hard alloys of the present invention further containing VC, TaC or NbC has excellent strength, toughness, room-temperature and high-temperature hardnesses, as well as oxidation resistance.

When guide rollers for hot-rolling rolls were prepared from the above hard alloys 61, 64, 72 and 79 and tested by assembling in an actual operating machine, each guide roller incurred only slight thermal cracks recognizable at the caliber portion even after the passing of 2,500 tons or more of wires, and was judged to be serviceable for further use.

TABLE 6

| Kind of alloy | | Composition (wt. %) Cr | Al | Ni | Co | VC | TaC | NbC | Mo | B | Zr | WC | Oxygen content in alloy (%) |
|---|---|---|---|---|---|---|---|---|---|---|---|---|---|
| Hard alloys of the invention | 61 | 0.2 | 1 | 10 | 5 | 1 | — | — | — | — | — | Remainder | 0.04 |
| | 62 | 1 | 1 | 10 | 5 | 1 | — | — | — | — | — | " | 0.04 |
| | 63 | 2 | 1 | 10 | 5 | 1 | — | — | — | — | — | " | 0.05 |
| | 64 | 1 | 0.2 | 10 | 5 | — | 1 | — | — | — | — | " | 0.02 |
| | 65 | 1 | 3 | 30 | 5 | — | 1 | — | — | — | — | " | 0.05 |
| | 66 | 1 | 1 | 5 | 5 | — | — | 1 | — | — | — | " | 0.04 |
| | 67 | 1 | 2 | 15 | 5 | — | — | 1 | — | — | — | " | 0.05 |
| | 68 | 1 | 1 | 10 | 10 | 0.5 | 0.5 | — | — | — | — | " | 0.04 |
| | 69 | 1 | 1 | 10 | 15 | — | 0.5 | 0.5 | — | — | — | " | 0.03 |
| | 70 | 1 | 1 | 10 | 5 | 0.1 | — | — | — | — | — | " | 0.04 |
| | 71 | 1 | 1 | 10 | 5 | 2 | — | — | — | — | — | " | 0.05 |
| | 72 | 1 | 1 | 10 | 5 | — | 0.1 | — | — | — | — | " | 0.04 |
| | 73 | 1 | 1 | 10 | 5 | — | 2 | — | — | — | — | " | 0.05 |
| | 74 | 1 | 1 | 10 | 5 | — | — | 0.1 | — | — | — | " | 0.03 |
| | 75 | 1 | 1 | 10 | 5 | — | — | 2 | — | — | — | " | 0.05 |
| | 76 | 1 | 1 | 10 | 5 | 1 | — | — | 0.2 | — | — | " | 0.03 |
| | 77 | 1 | 1 | 10 | 5 | 0.5 | 0.5 | — | 0.5 | — | — | " | 0.03 |
| | 78 | 1 | 1 | 10 | 5 | 0.5 | — | 0.5 | 0.8 | — | — | " | 0.05 |
| | 79 | 1 | 1 | 10 | 5 | — | 1 | — | — | 0.02 | — | " | 0.04 |

TABLE 6-continued

| | | | | | | | | | | | | |
|---|---|---|---|---|---|---|---|---|---|---|---|---|
| | 80 | 1 | 1 | 10 | 5 | — | 1 | — | — | 0.1 | — | " | 0.04 |

| Kind of alloy | | Average particle size of WC particles in alloy (μm) | Tensile strength (Kg/mm²) | Transverse rupture strength (Kg/mm²) | Hardness Room temperature (HRA) | Hardness 800° C. (Hv) | Increased weight by oxidation (mg/cm²) |
|---|---|---|---|---|---|---|---|
| Hard alloys of the invention | 61 | 3.8 | 142 | 318 | 86.8 | 490 | 3.9 |
| | 62 | 3.8 | 138 | 300 | 87.0 | 505 | 3.5 |
| | 63 | 3.8 | 130 | 280 | 87.5 | 515 | 2.8 |
| | 64 | 3.8 | 140 | 312 | 86.6 | 485 | 3.9 |
| | 65 | 2.2 | 132 | 290 | 79.0 | 388 | 2.4 |
| | 66 | 6.9 | 141 | 288 | 87.8 | 455 | 5.9 |
| | 67 | 3.2 | 155 | 318 | 84.8 | 475 | 3.2 |
| | 68 | 3.2 | 149 | 300 | 84.3 | 450 | 3.5 |
| | 69 | 2.9 | 158 | 305 | 85.5 | 450 | 3.0 |
| | 70 | 3.8 | 140 | 311 | 86.7 | 498 | 3.5 |
| | 71 | 3.8 | 135 | 280 | 87.5 | 520 | 3.7 |
| | 72 | 3.8 | 141 | 310 | 86.5 | 500 | 3.6 |
| | 73 | 3.8 | 136 | 281 | 87.4 | 508 | 3.6 |
| | 74 | 3.8 | 141 | 312 | 86.6 | 504 | 3.7 |
| | 75 | 3.8 | 137 | 282 | 87.2 | 510 | 3.6 |
| | 76 | 3.8 | 139 | 280 | 86.7 | 504 | 3.4 |
| | 77 | 3.8 | 141 | 310 | 87.2 | 507 | 3.5 |
| | 78 | 3.8 | 135 | 295 | 87.5 | 518 | 3.8 |
| | 79 | 3.8 | 145 | 335 | 87.2 | 503 | 3.2 |
| | 80 | 3.8 | 132 | 291 | 87.1 | 502 | 2.9 |

TABLE 7

| Kind of alloy | | Composition (wt. %) Cr | Al | Ni | Co | VC | TaC | NbC | Mo | B | Zr | WC | Oxygen content in alloy (%) |
|---|---|---|---|---|---|---|---|---|---|---|---|---|---|
| Hard alloys of the invention | 81 | 1 | 1 | 10 | 5 | — | — | 1 | — | 0.2 | — | Remainder | 0.02 |
| | 82 | 1 | 1 | 10 | 5 | 0.5 | 0.5 | 0.5 | — | — | 0.01 | " | 0.04 |
| | 83 | 1 | 1 | 10 | 5 | 1 | — | — | — | — | 0.18 | " | 0.03 |
| | 84 | 1 | 1 | 10 | 5 | 0.5 | 0.5 | — | — | 0.05 | 0.05 | " | 0.05 |
| | 85 | 1 | 1 | 10 | 5 | — | 0.5 | 0.5 | 0.5 | 0.05 | — | " | 0.05 |
| | 86 | 1 | 1 | 10 | 5 | 0.5 | 0.5 | 0.5 | 0.5 | 0.05 | 0.05 | " | 0.05 |
| Comparative hard alloys | 61 | —* | 1 | 10 | 5 | 0.5 | 0.5 | — | — | — | — | " | 0.02 |
| | 62 | 1 | —* | 10 | 5 | — | 0.5 | 0.5 | — | — | — | " | 0.02 |
| | 63 | 1 | 1 | 4* | 5 | — | 1 | — | — | — | — | " | 0.04 |
| | 64 | 1 | 1 | 32* | 5 | 1 | — | — | — | — | — | " | 0.04 |
| | 65 | 1 | 1 | 10 | 2* | — | — | 1 | — | — | — | " | 0.04 |
| | 66 | 1 | 1 | 10 | 16* | — | — | 1 | — | — | — | " | 0.04 |
| | 67 | 1 | 1 | 10 | 5 | —* | —* | —* | — | — | — | " | 0.02 |
| | 68 | 1 | 1 | 10 | 5 | 0.5 | — | 0.5 | — | — | — | " | 0.03 |
| | 69 | 1 | 1 | 10 | 5 | 0.5 | 0.5 | 0.5 | — | — | — | " | 0.03 |

| Kind of alloy | | Average particle size of WC particles in alloy (μm) | Tensile strength (Kg/mm²) | Transverse rupture strength (Kg/mm²) | Hardness Room temperature (HRA) | Hardness 800° C. (Hv) | Increased weight by oxidation (mg/cm²) |
|---|---|---|---|---|---|---|---|
| Hard alloys of the invention | 81 | 3.8 | 128 | 277 | 87.7 | 522 | 2.1 |
| | 82 | 3.8 | 143 | 309 | 86.6 | 492 | 3.8 |
| | 83 | 3.8 | 122 | 275 | 87.5 | 518 | 2.3 |
| | 84 | 3.8 | 134 | 290 | 86.8 | 490 | 2.5 |
| | 85 | 3.8 | 136 | 280 | 87.1 | 507 | 2.1 |
| | 86 | 3.8 | 135 | 283 | 87.2 | 494 | 2.5 |
| Comparative hard alloys | 61 | 3.8 | 135 | 270 | 86.0 | 446 | 5.8 |
| | 62 | 3.8 | 130 | 255 | 85.2 | 430 | 6.0 |
| | 63 | 7.0 | 112 | 266 | 87.3 | 490 | 7.3 |
| | 64 | 2.0 | 125 | 240 | 77.2 | 354 | 2.8 |
| | 65 | 3.5 | 125 | 245 | 86.6 | 477 | 4.4 |
| | 66 | 2.9 | 145 | 290 | 79.1 | 370 | 3.4 |
| | 67 | 4.3 | 140 | 300 | 85.8 | 477 | 5.8 |
| | 68 | 1.5* | 120 | 226 | 88.5 | 510 | 3.5 |
| | 69 | 9* | 125 | 236 | 82.5 | 380 | 2.9 |

As can be seen from each Example as described above, the WC-base hard alloy of the present invention is excellent particularly in high-temperature strength and oxidation resistance and has a high hardness at high temperature. Moreover, it is also excellent in hot impact resistance and hot fatigue resistance as well as in toughness and abrasion resistance. Thus, it can exhibit excellent performance for a very long time when employed as hot-working apparatus members for which these characteristics are required.

What is claimed is:

1. A tungsten carbide-base hard alloy suitable for hot-working apparatus members, said alloy having a disperse phase and a binder phase and consisting of, by weight, 0.1–2% of Cr, 0.1–3% of Al, 5–30% of Ni, 2.5–15% of Co, 0–0.2% in total of one or both of B and Zr, and 0–2% in total of at least one of vanadium carbide, tantalum carbide and niobium carbide, the remainder of said alloy being tungsten carbide and inevitable impurities, said Al content having been produced in situ in said alloy from AlN, said alloy having substantially no nitrogen remaining therein, wherein the content of oxygen as an inevitable impurity is not more than 0.05%; said tungsten carbide forms said disperse phase of an average particle size of 2–8 μm; and said binder phase contains fine particles of precipitated γ′ phase of $Ni_3Al$ structure.

2. An alloy according to claim 1, wherein the average particle size of the γ′ phase is 0.3 μm or less.

3. An alloy according to claim 1, wherein said Cr is introduced by addition of $Cr_2N$.

4. An alloy according to claim 1, wherein containing at least one of B and Zr in a quantity of 0.01 to 0.2% by weight.

5. An alloy according to any one of claims 1 and 4, containing at least one of vanadium carbide, tantalum carbide and niobium carbide in a quantity of 0.1 to 2% by weight.

6. An alloy according to claim 1, wherein the content of the tungsten carbide is 50% or more.

7. An alloy according to claim 1, which is in the form of powder.

* * * * *